US007911425B2

(12) United States Patent
Goden et al.

(10) Patent No.: US 7,911,425 B2
(45) Date of Patent: Mar. 22, 2011

(54) DISPLAY DEVICE

(75) Inventors: Tatsuhito Goden, Kawasaki (JP); Somei Kawasaki, Saitama (JP); Masami Iseki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 654 days.

(21) Appl. No.: 11/917,068

(22) PCT Filed: Mar. 30, 2007

(86) PCT No.: PCT/JP2007/057708

§ 371 (c)(1),
(2), (4) Date: Dec. 10, 2007

(87) PCT Pub. No.: WO2007/116950

PCT Pub. Date: Oct. 18, 2007

(65) Prior Publication Data

US 2009/0231239 A1 Sep. 17, 2009

(30) Foreign Application Priority Data

Mar. 31, 2006 (JP) ..... 2006-098011

(51) Int. Cl.
*G09G 3/30* (2006.01)

(52) U.S. Cl. ..... 345/76; 345/690

(58) Field of Classification Search ..... 345/76
See application file for complete search history.

(56) References Cited

U.S. PATENT DOCUMENTS

| | | | | |
|---|---|---|---|---|
| 7,242,397 | B2 | 7/2007 | Iseki et al. | 345/77 |
| 2004/0183752 | A1 | 9/2004 | Kawasaki et al. | 345/20 |
| 2005/0122150 | A1 | 6/2005 | Iseki et al. | 327/215 |
| 2005/0168491 | A1 * | 8/2005 | Takahara et al. | 345/690 |
| 2005/0285151 | A1 | 12/2005 | Kawasaki | 257/213 |
| 2006/0114194 | A1 | 6/2006 | Kawasaki et al. | 345/76 |
| 2006/0114195 | A1 | 6/2006 | Yamashita et al. | 345/76 |
| 2006/0132395 | A1 | 6/2006 | Kawasaki et al. | 345/75.2 |
| 2006/0187185 | A1 | 8/2006 | Yoshinaga et al. | 345/107 |
| 2007/0132719 | A1 | 6/2007 | Yamashita et al. | 345/156 |

* cited by examiner

*Primary Examiner* — Amare Mengistu
*Assistant Examiner* — Jennifer Zubajlo
(74) *Attorney, Agent, or Firm* — Fitzpatrick, Cella, Harper & Scinto

(57) ABSTRACT

In a current driving display device, a first operation in which pixel circuits in odd rows are sequentially scanned to set a current supplied to display elements and a second operation in which pixel circuits in even rows are sequentially scanned to set a current supplied to display elements are alternately repeated. The current set in the pixel circuits is supplied to the display elements in parallel with the first and second operations, and the number of times in the period is twice or more than the number of times in which the pixel circuit sets a current supplied to the display element.

8 Claims, 18 Drawing Sheets

DISPLAY DEVICE

TECHNICAL FIELD

The present invention relates to a display device in which electroluminescent (EL) elements emitting light according to an input current are arranged in a matrix, and in particular, to an active matrix display device displaying images by an interlace system using current-driven display elements and current programming pixel circuits and to electronic appliances such as a digital camera equipped with the active matrix display device.

BACKGROUND ART

A self light-emitting display using light emitting elements has drawn attention as a next generation display in recent years. Among others, a display is known using an organic EL element of a current controlled light emitting element in which brightness is controlled by current, or an organic EL display. The organic EL display includes an active matrix type using a thin film transistor (TFT) in its display area and peripheral circuits. As one of its driving systems, a current programming system is used in which a current amount corresponding to image data is set in pixel circuits formed in pixels to cause the organic EL elements to emit light.

FIG. 16 illustrates an example configuration of a pixel circuit including an EL element using a conventional current programming system.

In FIG. 16, reference characters P1 and P2 denote scanning signals. A current data "Idata" is input as a data signal. The anode of the EL element is connected to the drain terminal of the TFT (M4) and the cathode of the EL element is connected to a ground potential CGND. Reference characters M1, M2 and M4 represent a p-type TFT and M3 indicates an n-type TFT.

FIG. 17 is a timing chart describing a method of driving a pixel circuit 2.

In FIG. 17, reference character (a) denotes a current data supplied to the current data Idata. Reference characters (b) and (c) signify scanning signals supplied to the scanning signals P1 and P2 respectively. A pixel to be noted is considered to be located in the i-th row.

Reference characters I(i−1), I(i) and I(i+1) indicate a current data Idata input into the pixel circuits 2 in the target columns in a row i−1 (preceding a target row by one row), a row i (a target row) and a row i+1 (succeeding the target row by one row).

First, at the point before a time t0 and in the pixel circuits 2 in the target row, a "Low" level signal is input into the scanning signal P1 and a "High" level signal is input into the scanning signal P2. The transistors M2 and M3 are turned off and M4 is turned on. In this state, a current data I(i−1) corresponding to the current data Idata preceding by one row is not input into the pixel circuits 2 in the target row i.

Secondly, at the time t0, the High level signal is input into the scanning signal P1 and the Low level signal is input into the scanning signal P2. The transistors M2 and M3 are turned on and M4 is turned on. In this state, the current data I(i) corresponding to the current data Idata in the target row is input into the pixel circuit 2 in the row i. At this point, the transistor M4 does not conduct, so that a current does not flow into the EL element. The input current data Idata develops a voltage according to the current driving capability of the transistor M1 across a capacitor C1 arranged between the gate terminal of the transistor M1 and the power source potential VCC.

Next, at the time t1, the High level signal is input into the scanning signal P2 and the transistor M2 is turned off. Subsequently, at the time t2, the Low level signal is input into the scanning signal P1 and the transistor M3 is turned off and the transistor M4 is turned on. At this state, since the transistor M4 conducts, a voltage developed across the capacitor C1 supplies the EL element with a current according to the current driving capability of the transistor M1. This causes the EL element to emit light with a brightness according to the supplied current.

However, a current flowing into an organic EL element in one pixel is very small and, in particular, the current data Idata causing the organic EL element to emit light with a low brightness is extremely small. For this reason, it takes quite much time to charge a data line at the time of programming a desired current, so that one scanning period (the period during which the scanning signal P2 is supplied with the Low level signal from time t0 to time t1) is not enough. Although a duty driving has been known in which a comparatively large current is set to the pixel circuit to control a light emitting period to control brightness, a flicker is generated unless the driving is performed with a high frequency to some extent.

For that purpose, Japanese Patent Application Laid-Open No. 2005-031635 proposes a display device in which a light emitting period is controlled by the duty driving while a display is being performed by the interlace system which forms one frame of two fields (odd and even fields).

FIG. 18 is a timing chart describing a method of driving a display device according to Japanese Patent Application Laid-Open No. 2005-031635.

In FIG. 18, one frame (or 1 frame in the figure) is composed of an "ODD field" and an "EVEN field". Reference characters 1 to m denote row numbers in the display device. Reference characters X(1) to X(m) indicate scanning signals corresponding to each row. A row is selected during the input of the High level signal to perform the current programming. Reference characters Z(1) to Z(m) signify light emitting period controlling signals corresponding to each row. The element emits light during the input of the Low level signal and does not emit light during the input of the High level signal. In the odd field, only odd rows are selected to perform the current programming. In the even field, only even rows are selected to perform the current programming.

Thus, control lines corresponding to odd and even lines are separately driven and the EL elements are subjected to a duty drive, differentiating a light emitting period from a non-light emitting period between adjacent lines to remove flicker.

DISCLOSURE OF THE INVENTION

However, if one field is set to be 60 Hz based on a conventional driving method, one frame will be 30 Hz. In other words, a driving frequency repeating a light emission and a non-light emission at a certain line is 30 Hz, which is not a high frequency enough to prevent flicker. This degrades image quality.

The present invention relates to a display device controlling a light emitting period while current-programming by the interlace system and has its purpose to provide a method of driving the display device capable of delivering an excellent display by suppressing flicker.

In order to achieve the above purpose a display device according to the present invention is characterized by comprising:

an image display unit comprising a plurality of sets of a display element and a pixel circuit arranged in a matrix in rows and columns, a brightness of the display element being controlled by a current flowing through the display element, and the pixel circuit holding a brightness signal and generating a current according to the brightness signal to supply to the display element;

a first and a second scanning line provided in each row of the image display unit;

a row driving circuit which outputs a first scanning signal to the first scanning lines to define a period for setting the brightness signal to the pixel circuit and a second scanning signal to the second scanning lines to define a period during which the pixel circuit supplies the current to the display element;

a data line provided in each column of the image display unit; and a column driving circuit which outputs the brightness signal the data lines; wherein the following two operations are alternately repeated:

a first operation in which the row driving circuit outputs the first scanning signals to the first scanning lines in the odd rows and the column driving circuit outputs the brightness signal to the data lines to set the brightness signal to the pixel circuit in the odd rows of the image display unit; and a second operation in which the row driving circuit outputs the first scanning signals to the first scanning lines in the even rows and the column driving circuit outputs the brightness signal to the data lines to set the brightness signal to the pixel circuit in the even rows of the image display unit, and the second scanning signals are applied twice or more times to each of the second scanning lines in a period of the first and second operation.

According to the present invention, a plurality of the light emitting periods is provided in each field while the current programming is performed by the interlace system. Thus, the current programming is performed at 30 Hz (or, once per frame in each row) for cases where the driving frequency of one field is taken to be 60 Hz, but light can be emitted at 60 Hz (or, once per field in each row). Thus, the driving frequency of light emission/non-light emission can be twice or more than that of the current programming to suppress the generation of flickers.

Further features of the present invention will become apparent from the following description of exemplary embodiments with reference to the attached drawings.

BEST MODES FOR CARRYING OUT THE INVENTION

The best mode for carrying out the present invention on the display device is described in detail below. The present invention is applied to an active matrix display device using EL elements which controls a light emitting period while current-programming by the interlacing system.

Although an organic EL display device using EL elements is taken as an example in the description of the following embodiments, a display device according to the present invention is not limited to the EL display device, but the invention can be universally applied to a device capable of controlling the display of pixels by current signals.

First Embodiment

Figure 1:
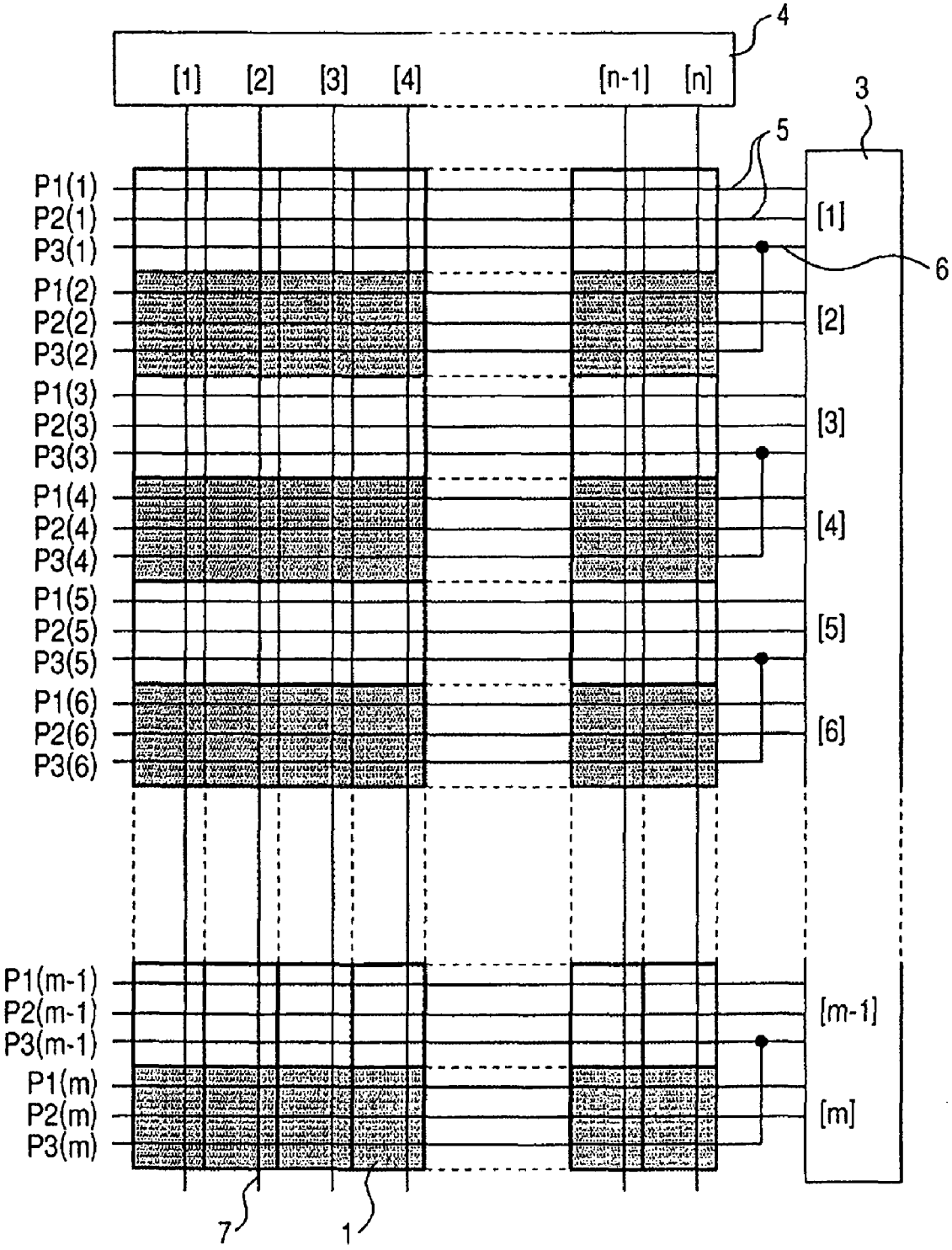
FIG. 1 is one example of a display device according to the present invention.

FIG. 1 illustrates the overall configuration of a display device according to the present embodiment.

In FIG. 1, an image display unit includes a pixel 1 formed of an EL element with RGB three primary colors and a pixel circuit composed of TFTs for controlling a current input into the EL element. The pixels are arranged in a matrix of m rows and n columns in the image display unit. A row number "m" is even.

A row driving circuit 3 and a column driving circuit 4 are arranged at the periphery of a display area.

The output terminals of the row driving circuit 3 output first scanning signals P1(1) to P1(*m*) and P2(1) to P2(*m*) and second scanning signals P3(1) to P3(*m*). The first scanning signals and the second scanning signals are input into pixel circuits (the circuits 2 in FIG. 2 described later) provided in pixels 1 of each row via first scanning lines 5 and second scanning lines 6 respectively. The second scanning lines 6 of adjacent odd and even rows are commonly connected to make a paring. That is to say, the same second scanning signals are input into the first and the second rows, the third and fourth rows, the fifth and the six rows, and the (m−1)th and the m-th rows. In the present embodiment, although the second scanning lines 6 are commonly connected every two rows, the same second scanning signals may be output every two rows from the row driving circuit 3 instead of commonly connecting the lines 6.

A video signal is input into the column driving circuit 4. The output terminals thereof output a current data Idata. The current data Idata is input into the pixel circuits of each column through data lines 7.

In the present invention, a current programming is performed by the interlace system. One frame is formed of two fields each being an odd and an even field. In the odd field, pixels 1 in the first, the third, the fifth and the (m−1)th row which are odd rows are sequentially selected. In the even field, pixels 1 in the second, the fourth, the sixth and the m-th row which are even rows are sequentially selected.

Figure 2:
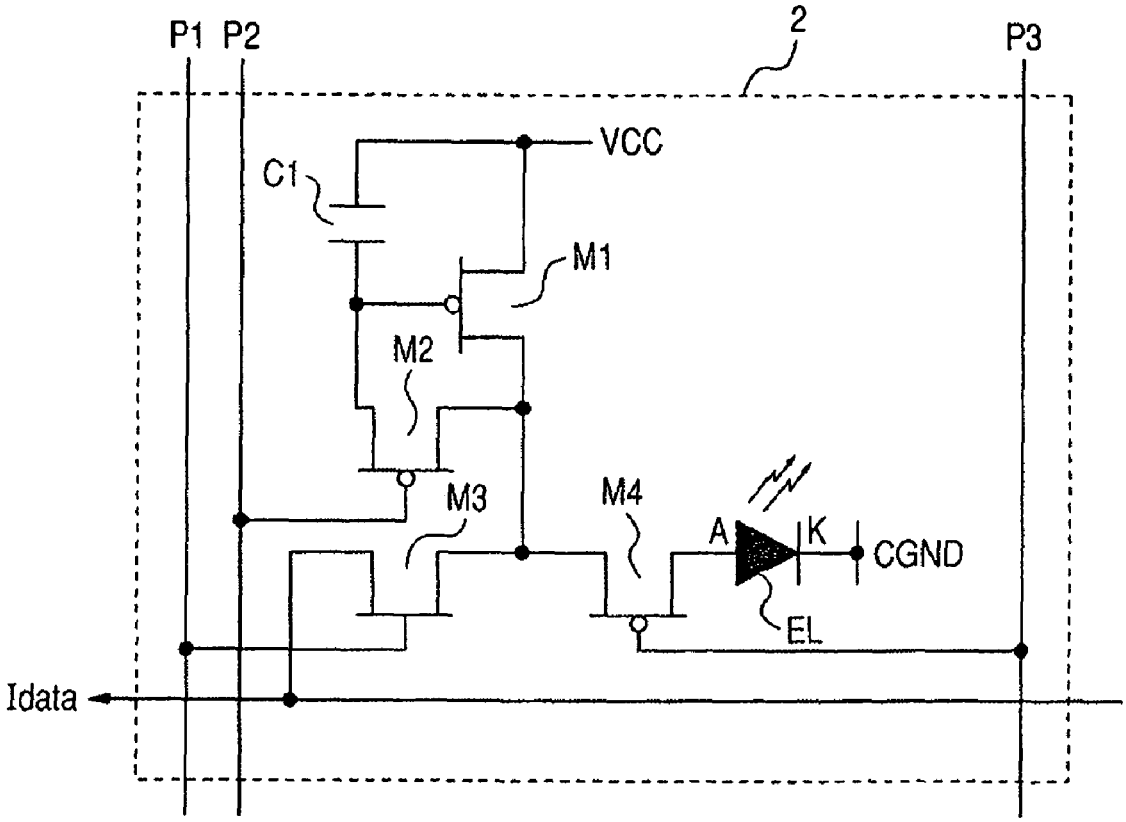
FIG. 2 is one example of a pixel circuit in the display device according to the present invention.

FIG. 2 shows an example configuration of a pixel circuit 2 including the EL element in the present embodiment.

In FIG. 2, reference characters P1 and P2 denote scanning signals. Reference character P3 indicates a light emitting period controlling signal. The current data Idata is input as a data signal. The anode of the EL element is connected to the drain terminal of the TFT (M4) and the cathode of the EL element is connected to a ground potential CGND. Reference characters M1, M2 and M4 denote a P-type TFT and M3 an n-type TFT.

Figure 3:
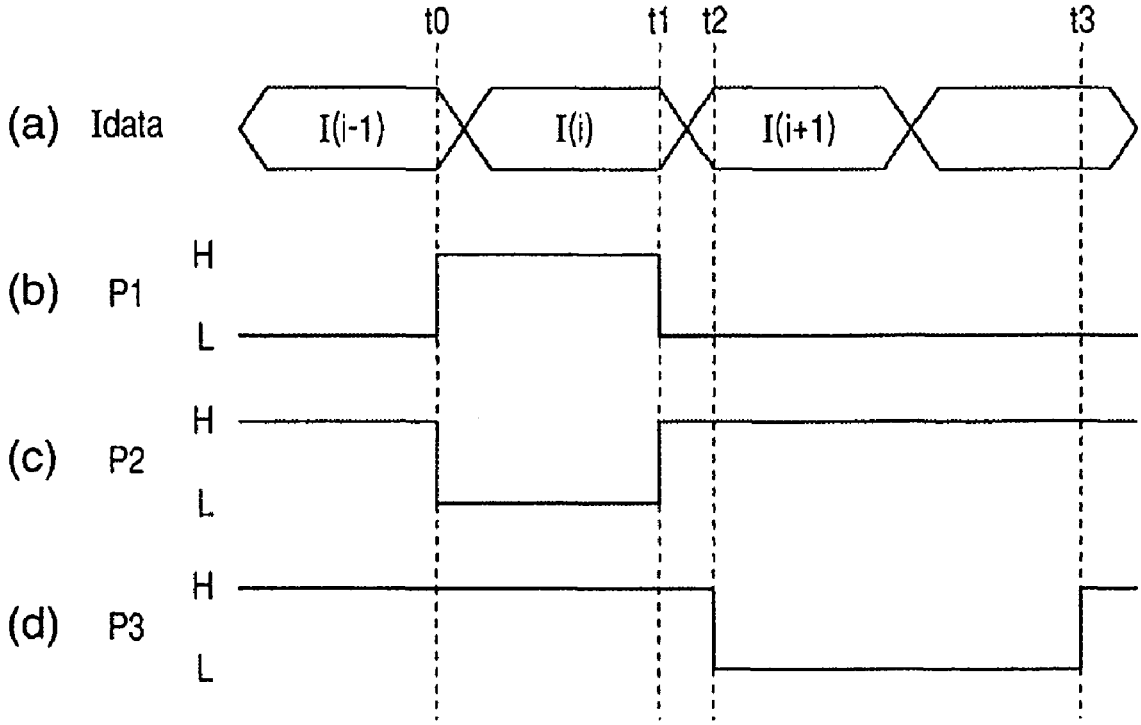
FIG. 3 is a timing chart describing the operation of the pixel circuit illustrated in FIG. 2.

FIG. 3 is a timing chart describing a method of driving the pixel circuit 2.

In FIG. 3, reference characters I(i−1), I(i) and I(i+1) signify the current data Idata input into the pixel circuits 2 in a target column and in a row i−1 (preceding a target row by one row), a row i (the target row) and a row i+1 (succeeding the target row by one row) for each field.

First, at the point before a time t0 and in the pixel circuits 2 in the target row, a "Low" level signal is input as one of the first scanning signals P1, a "High" level signal is input as the other first scanning signal P2 and the "High" level signal is input into the second scanning signal P3. The transistors M2 and M3 are turned off and M4 is turned off. In this state, the current data I(i−1) corresponding to the current data Idata preceding by one row is not input into the pixel circuits 2 in the target row m.

Secondly, at the time t0, the High level signal is input into the first scanning signal P1 and the Low level signal is input into the first scanning signal P2. The transistors M2 and M3 are turned on and M4 is turned off. In this state, the current data I(i) corresponding to the current data Idata in the target row is input into the pixel circuits 2 in the row m. At this point, the second scanning signal P3 keeps the High level signal as it is and the transistor M4 does not conduct, so that current does not flow into the EL element. The input Idata develops a voltage according to the current driving capability of the transistor M1 across a capacitor C1 arranged between the gate terminal of the transistor M1 and the power source potential VCC. The voltage across the gate terminal is determined to be held by the capacitor C1 to flow the Idata and is referred to as "current programming."

Next, at the time t1, the Low level signal is input as the first scanning signal P1, the High level signal is input as the first scanning signal P2, and the transistors M2 and M3 are turned off.

The first scanning signals P1 and P2 determine a period from t0 to t1, during which the capacitor C1 is charged according to the current data Idata. The pixel circuit is controlled to acquire the current data from the data line during the first scanning signal is applied.

The selection period of this row is terminated at t1. Then, the first scanning signals P1 and P2 are applied to the first scanning lines of another row. The rows are sequentially selected to scan the whole display unit.

Subsequently, at the time t2, the Low level signal is input as the second scanning signal P3 and the transistor M4 is turned on. At this state, since the transistor M4 conducts, a voltage developed across the capacitor C1 supplies the EL element with a current according to the current driving capability of the transistor M1. This causes the EL element to emit light with a brightness according to the supplied current. Next, at the time t3, the High level signal is input into the scanning signal P3, and the transistor M4 is turned off, stopping the supply of current to the EL element to cause the EL element not to emit light. The period from the times t2 to t3 during which the Low level signal is input as the second scanning signal P3 is varied to control a light emitting period to control brightness.

This row-selection by the second scanning signal P3 is transferred to another row after t3. Selection is row by row to scan the whole display unit as well as the first scanning signal. The scanning may be the same as the scanning of the first scanning signal. That is, the row-selection of the second scanning signal follows the row-selection of the first scanning signal with a constant time delay.

Line selection sequence by the second scanning signal is, however, not necessarily the same as that of the first scanning signal. Various scanning schemes of the second scanning signal are described in the following paragraphs of the specification.

In the description of the present invention, the period from times t0 to t1 during which the High level signal is input into the scanning signal P1 is taken to be one scanning period.

Although the configuration of a pixel circuit in FIG. 2 is taken as one example in the present embodiment, a pixel circuit is not limited to the above.

Figure 4:
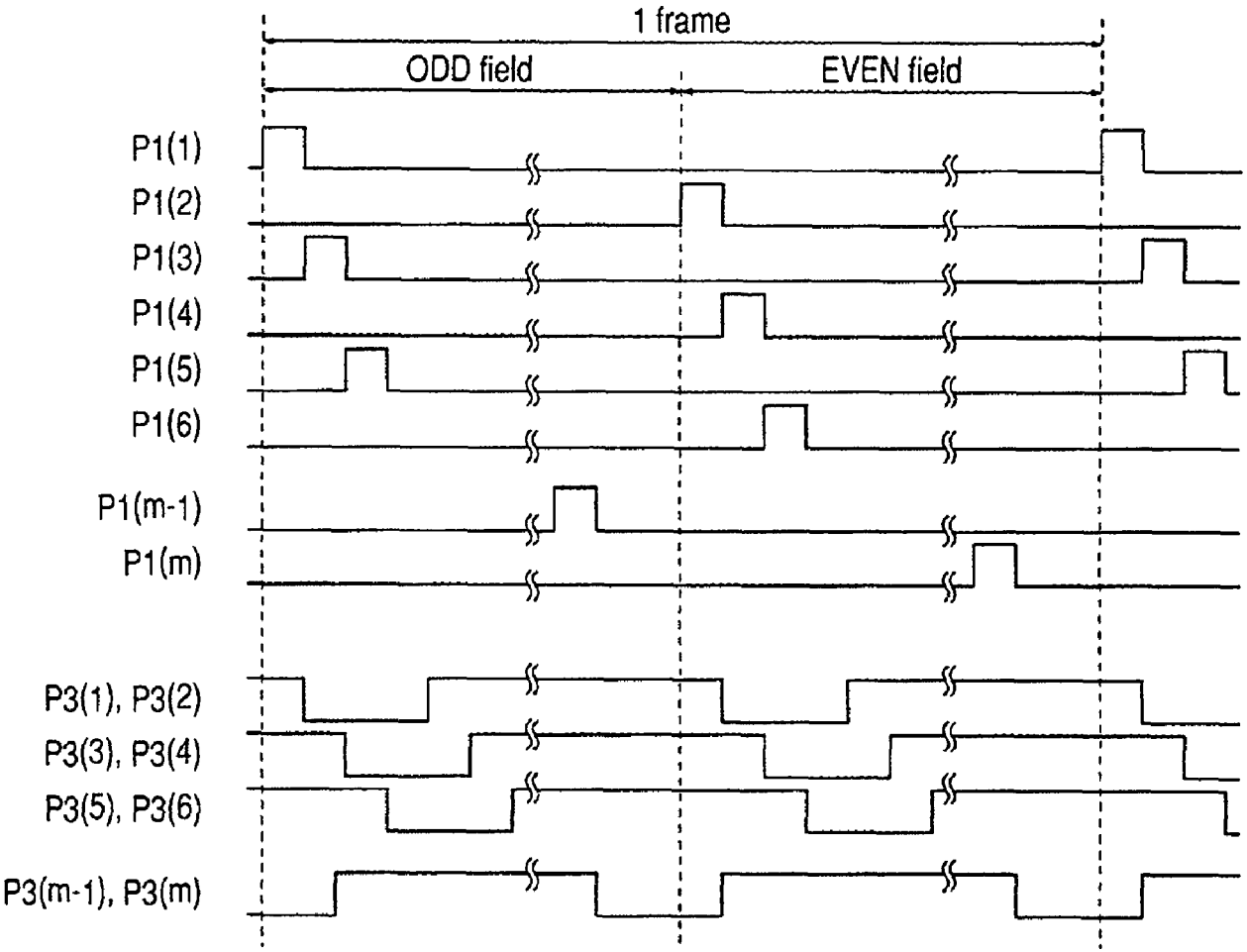
FIG. 4 is a timing chart describing the operation of the display device illustrated in FIG. 1.

FIG. 4 is a timing chart describing the operation of the display device in the present invention. In FIG. 4, reference characters P1(1) to P1(*m*) denote the scanning signal P1 corresponding to the first to the m-th row respectively. Reference characters P3(1) to P3(*m*) signify brightness control signals P3 corresponding to the first to the m-th row respectively. Since the same light emitting period controlling signals are input into the first and the second rows, the third and fourth rows, the fifth and the six rows, and the (m−1)th and the m-th rows, P3(1)=P3(2), P3(3)=P3(4), P3(5)=P3(6), . . . , and P3(*m*−1)=P3(*m*). The scanning signals P2 are output in the same timing as described in FIG. 3, although they are not illustrated for the sake of simplicity.

In the present invention, one frame ("1 frame" in the figure) is formed of an "ODD field" and an "EVEN field" in the figure to display images by the interlace system.

In the odd fields, the High level signals are sequentially input into the scanning signals P1(1), P1(3), P1(5), . . . , and P1(*m*−1) in the first, the third the fifth, . . . , and the (m−1)th row of the odd rows. In other words, the current data Idata is applied only to the pixel circuits 2 in the odd rows to perform the current programming.

In the even fields, the High level signals are sequentially input into the scanning signals P1(2), P1(4), P1(6), . . . , and P1(*m*) in the second, the fourth, the sixth, . . . , and the m-th row of the even rows. In other words, current data Idata is applied only to the pixel circuits 2 in the even rows to perform the current programming.

The light emitting period controlling signal P3 is a signal which causes the EL element to emit light during the input of the Low level signal.

The two rows (for example, the first and the second rows) into which the same scanning signal is input P3 keep the Low level signal period for a certain period after the current programming has been performed in any of fields, during which the EL elements emit light.

In the odd fields, the odd rows are subjected to current programming, and immediately thereafter, the EL elements emit light. At this point, since the EL elements in the even rows store data at the time of the previous programming, the EL elements emit light for the second time with the same brightness as in the previous even fields.

In the following even fields, the even rows are subjected to current programming, and immediately thereafter, the EL elements in the even rows emit light. The EL elements in the odd rows emit light according to the current programming to which the previous odd fields are subjected.

Thus, a light emitting period is provided for both fields which are subjected to and not subjected to current programming, so that the EL elements can be caused to emit light twice every current programming. In the light emitting period in the field which is not subjected to current programming, light is emitted by current programmed in the pixel circuit in the previous field. That is to say, the light emitting frequency is twice as high as the frame frequency, enabling flickers to be reduced.

Figure 5:
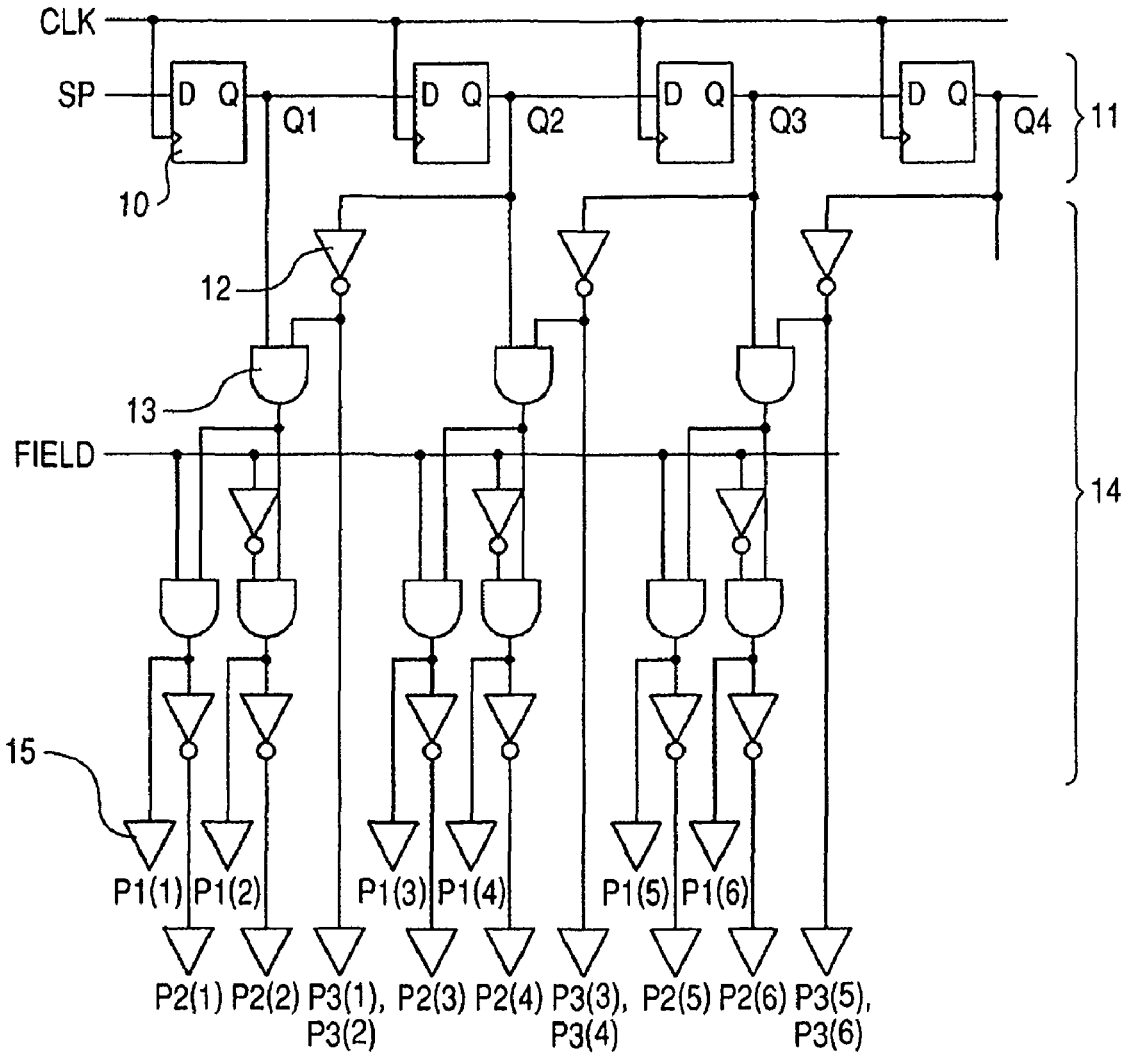
FIG. 5 is one example of a row driving circuit performing the operation of the display device illustrated in FIG. 4.

FIG. 5 shows one example of the row driving circuit 3 performing the operation of the display device illustrated in FIG. 4.

In FIG. 5, the row driving circuit 3 has a shift register 11 consisting of flip flops 10. The outputs of the shift register 11 are input into a logic circuit 14 consisting of NOT gates 12 and AND gates 13 to output the scanning signals P1, P2 and P3 through buffers 15. For the sake of simplicity, outputs only in the first to the sixth rows are illustrated.

Figure 6:
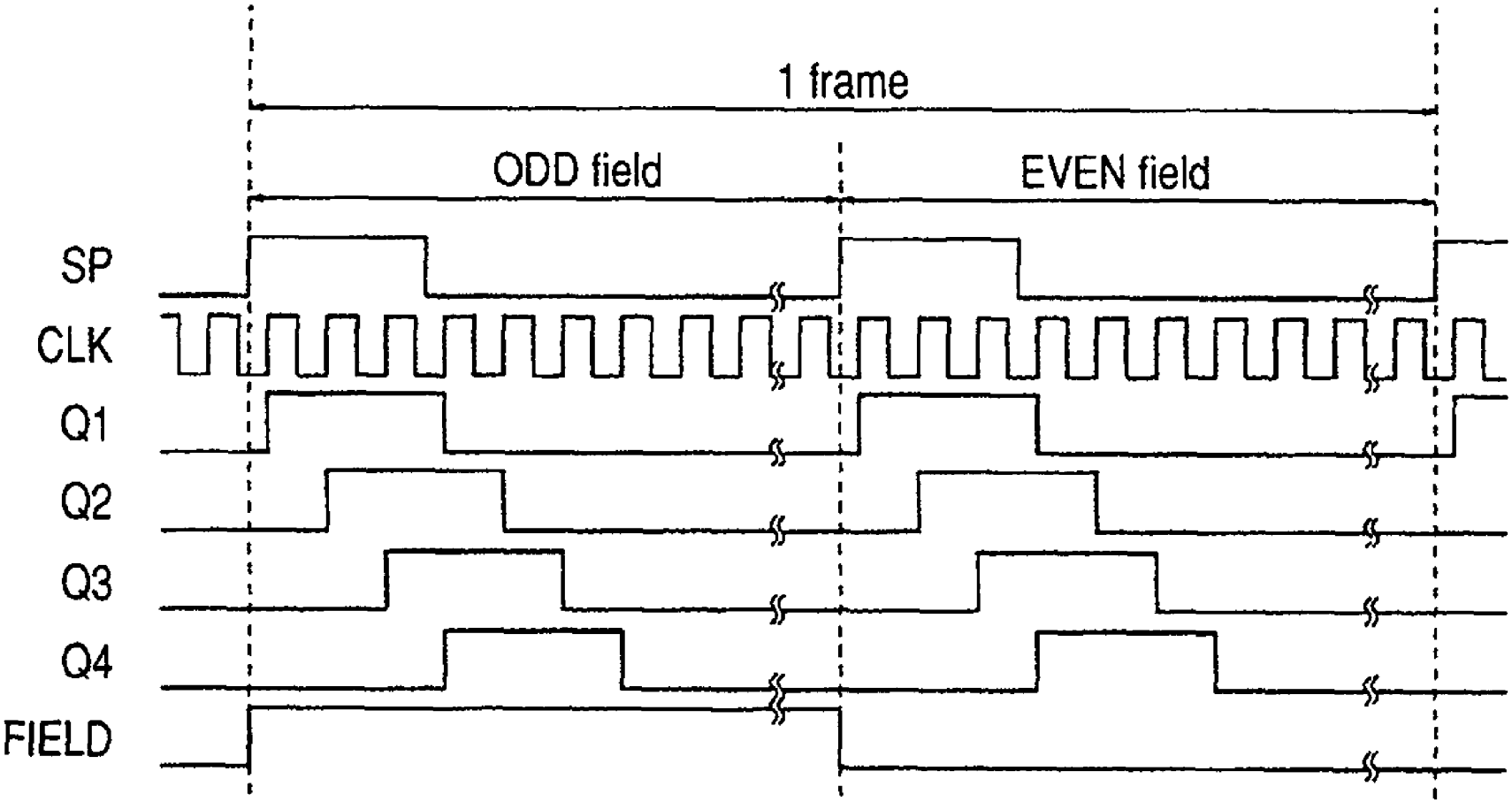
FIG. 6 is a timing chart describing the operation of the row driving circuit illustrated in FIG. 5.

FIG. 6 is a timing chart describing the operation of the row driving circuit illustrated in FIG. 5. Reference character SP denotes a start pulse signal input into the shift register 11. Reference character CLK indicates a clock signal sequentially transferring the start pulse signal SP input into the shift register 11. One period of the clock signal CLK is taken to be one scanning period. Reference characters Q1 to Q4 represent outputs from the flip flops 10 in the shift register 11. Reference character FIELD expresses a field signal determining whether a field is odd or even. The pixels in the odd rows are subjected to the current programming while the field signal FIELD is in the High level signal period and the pixels in the even rows are subjected to the current programming while the field signal FIELD is in the Low level signal period.

According to FIGS. 5 and 6, the scanning signals P1 and P2 of each row are generated by the outputs of the flip flops 10 at the stage corresponding to the rows and the flip flop 10 at the following stage in the shift register 11. The light emitting period controlling signal P3 is generated by the outputs of the flip flops 10 at the following stage.

The light emitting period can be controlled by varying the pulse width in the High level signal period of the start pulse signal SP to vary the pulse width of the Low level signal of the light emitting period controlling signal P3.

According to the timing chart illustrated in FIG. 3, the light emitting period controlling signal P3 is switched to the Low level signal at the time t2 after a certain time has passed from the time t1 when both the scanning signals P1 and P2 are switched in level. This can be done by further reducing the driving capacity of the buffer outputting the light emitting period controlling signal P3 than that of the buffers outputting the scanning signals P1 and P2, or by increasing the buffers outputting the light emitting period controlling signal P3 to a plurality of stages, or by providing a delay circuit by adding a capacitor.

In the present embodiment, although the row driving circuit based on the configuration in FIG. 5 is exemplified, aside from the above, any configuration may be used which enables embodying the driving method in FIG. 4.

As described above, according to the present embodiment, the light emitting period is provided in each field while the odd and the even field are alternately subjected to the current programming, so that the current programming is conducted at 30 Hz (or, once per frame in each row) for cases where the driving frequency of one field is taken to be 60 Hz, but light can be emitted at 60 Hz (or, once per field in each row). In other words, each pixel emits light twice for one current programming. Thus, the driving frequency of light emission/non-light emission can be twice as high as that of the current programming to suppress the generation of flicker.

In FIG. 4, the light emitting period (the pulse width of the light emitting period controlling signal P3) during which light emits twice in one frame is equally set. Timings in the odd and even fields are the same as each other. If the pulse width or timings are greatly different between the fields, a visible light-emitting intensity temporally averaged will be equal to the frame frequency, which does not produce an effect of suppressing flicker.

Second Embodiment

The overall configuration of a display device according to the present embodiment is the same as in FIG. 1. The pixel circuit 2 and a method of driving the circuit 2 are the same as those in FIGS. 2 and 3, so that description and figures thereof are omitted.

Figure 7:
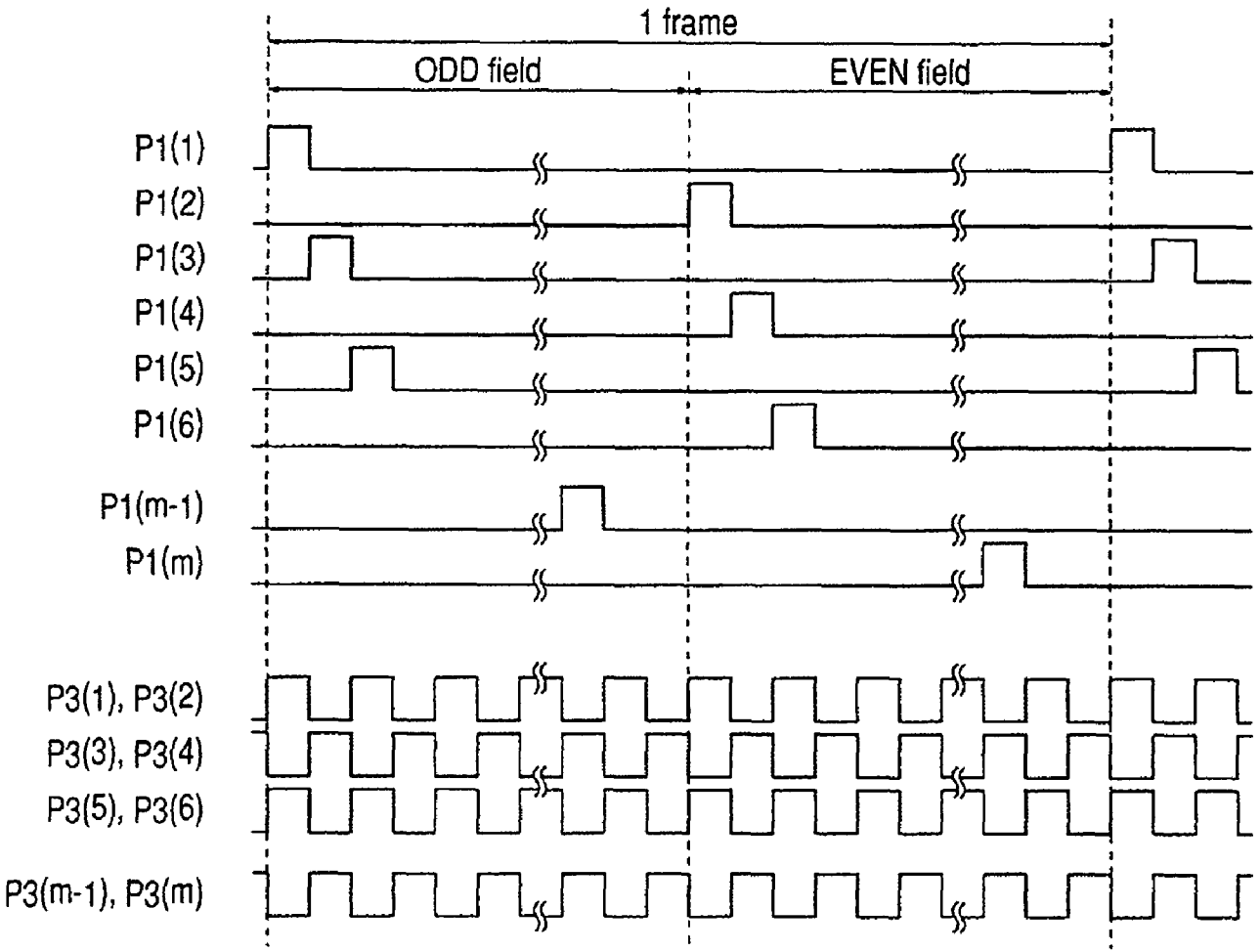
FIG. 7 is another timing chart describing the operation of the display device illustrated in FIG. 1.

FIG. 7 is another timing chart describing another method of driving the display device according to the present invention.

In FIG. 7, reference characters P1(1) to P1(*m*) denote the scanning signal P1 corresponding to the first to the m-th row respectively. Reference characters P3(1) to P3(*m*) signify brightness control signals P3 corresponding to the first to the m-th row respectively. Since the same light emitting period controlling signals are input into the first and the second rows, the third and fourth rows, the fifth and the six rows, and the (m−1)th and the m-th rows, P3(1)=P3(2), P3(3)=P3(4), P3(5)=P3(6), . . . , and P3(*m*−1)=P3(*m*). The scanning signals P2 are output in the same timing as described in FIG. 3, although they are not illustrated for the sake of simplicity.

The output waveforms of the light emitting period controlling signal P3 are different from those in the driving method described in the timing chart in FIG. 4.

The light emitting period controlling signal P3 in the present embodiment is sure to be in the High level signal period (non-light emitting period) for cases where the scanning signal P1 in any of two rows (for example, the first and the second rows) into which the same light emitting period controlling signal P3 is input) is in the high level signal period (the current programming period). In addition, several Low level signal periods (light emitting period) are provided during the interval before the following current programming after the present current programming has ended.

As is the case with the first embodiment, the light emitting period is provided both for the fields subjected to and not subjected to the current programming. In the light emitting period in the fields not subjected to the current programming, light is emitted by current programmed in the previous field. In the present embodiment, however, the EL element can repeat light emission/non-light emission plural times for one current programming.

Figure 8:
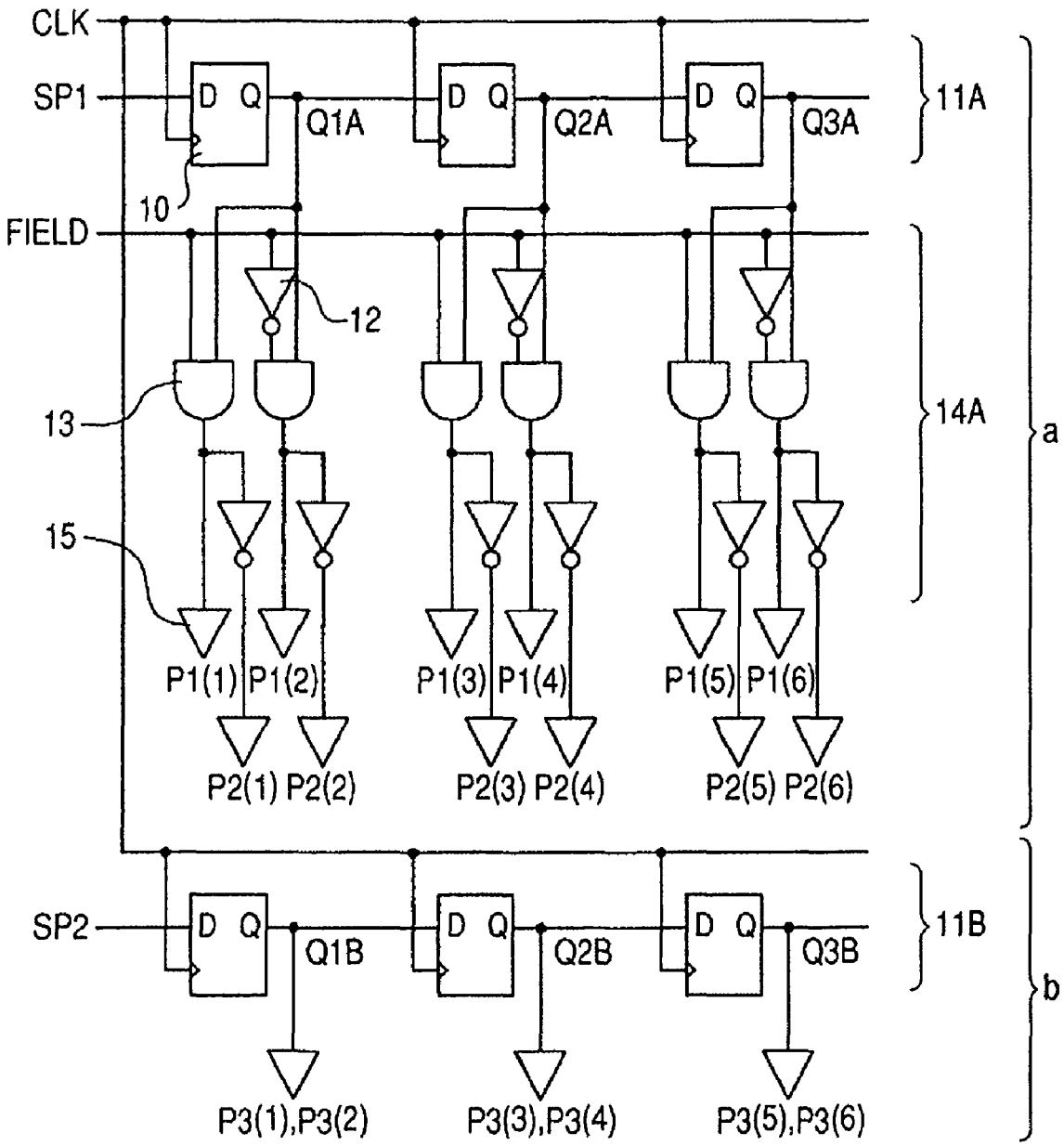
FIG. 8 is one example of the row driving circuit operating the display device illustrated in FIG. 7.

FIG. 8 shows one example of the row driving circuit 3 operated by the control signal in FIG. 7.

In FIG. 8, the row driving circuit 3 includes shift registers 11A and 11B consisting of flip flops 10. The outputs of the shift register 11A are input into a logic circuit 14A consisting of NOT gates 12 and AND gates 13 to output the scanning signals P1 and P2 through buffers 15. The outputs of the shift register 11B are output as the light emitting period controlling signal P3 through buffers 15. For the sake of simplicity, outputs only in the first to the sixth rows are illustrated.

Figure 9:
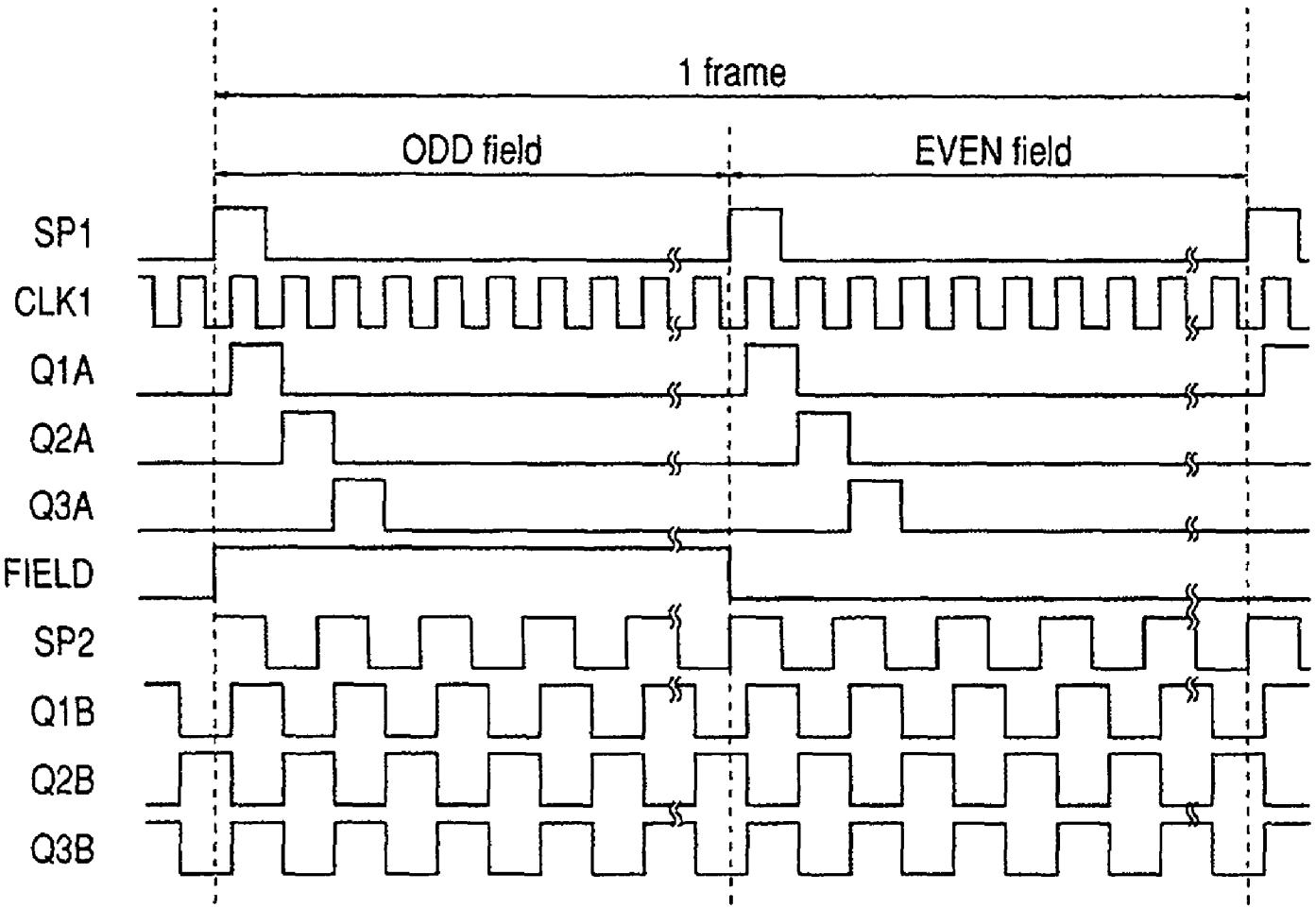
FIG. 9 is a timing chart describing the operation of the row driving circuit illustrated in FIG. 8.

FIG. 9 is a timing chart describing the operation of the row driving circuit illustrated in FIG. 8. Reference character SP1 denotes a start pulse signal 1 input into the shift register 11A. The pulse width of the High level signal is taken to be one scanning period. Reference character SP2 denotes a start pulse signal 2 input into the shift register 11B. Reference character CLK indicates a clock signal sequentially transferring the start pulse signals SP1 and SP2 commonly input into the shift registers 11A and 11B respectively. One period of the clock signal CLK is taken to be one scanning period. Reference characters Q1A to Q3A represent outputs from the flip flops 10 in the shift register 11A. Reference character Q1B to Q3B express outputs from the flip flops 10 in the shift register 11B. Reference character FIELD expresses a field signal determining whether a field is odd or even. The pixels in the odd rows are subjected to the current programming while the field signal FIELD is in the High level signal period and the pixels in the even rows are subjected to the current programming while the field signal FIELD is in the Low level signal period.

When the start pulse signal SP1 is in the High level signal period, the start pulse signal SP2 also is caused to be in the High level signal period. This surely causes the light emitting period controlling signal P3 to be in the High level signal period (non-light emitting period) when the scanning signal P1 is in the High level signal period (the current programming period).

The light emitting period can be controlled by varying the pulse width of the start pulse signal SP2 in the High level signal period to vary the pulse width of the Low level signal of the light emitting period controlling signal P3 or varying the number of times of the Low level signal period. In any case, however, a pulse period and a pulse interval are preferably the same anywhere. This is because only a specific pulse is elongated to cause temporal variations in a visible light emitting intensity to be equal to the frame frequency.

According to the timing chart illustrated in FIG. 3, the light emitting period controlling signal P3 is switched to the Low level signal at the time t2 after a certain time has passed from the time t1 when both the scanning signals P1 and P2 are switched in level. This can be done, as described in the first embodiment, by further reducing the driving capacity of the buffer outputting the light emitting period controlling signal P3 than that of the buffers outputting the scanning signals P1 and P2, or by increasing the buffers outputting the light emitting period controlling signal P3 to a plurality of stages, or by providing a delay circuit by adding a capacitor.

In the present embodiment, although common clock signals CLK are input into the shift registers 11A and 11B, separate clock signals may be input into each shift register.

Figure 10:
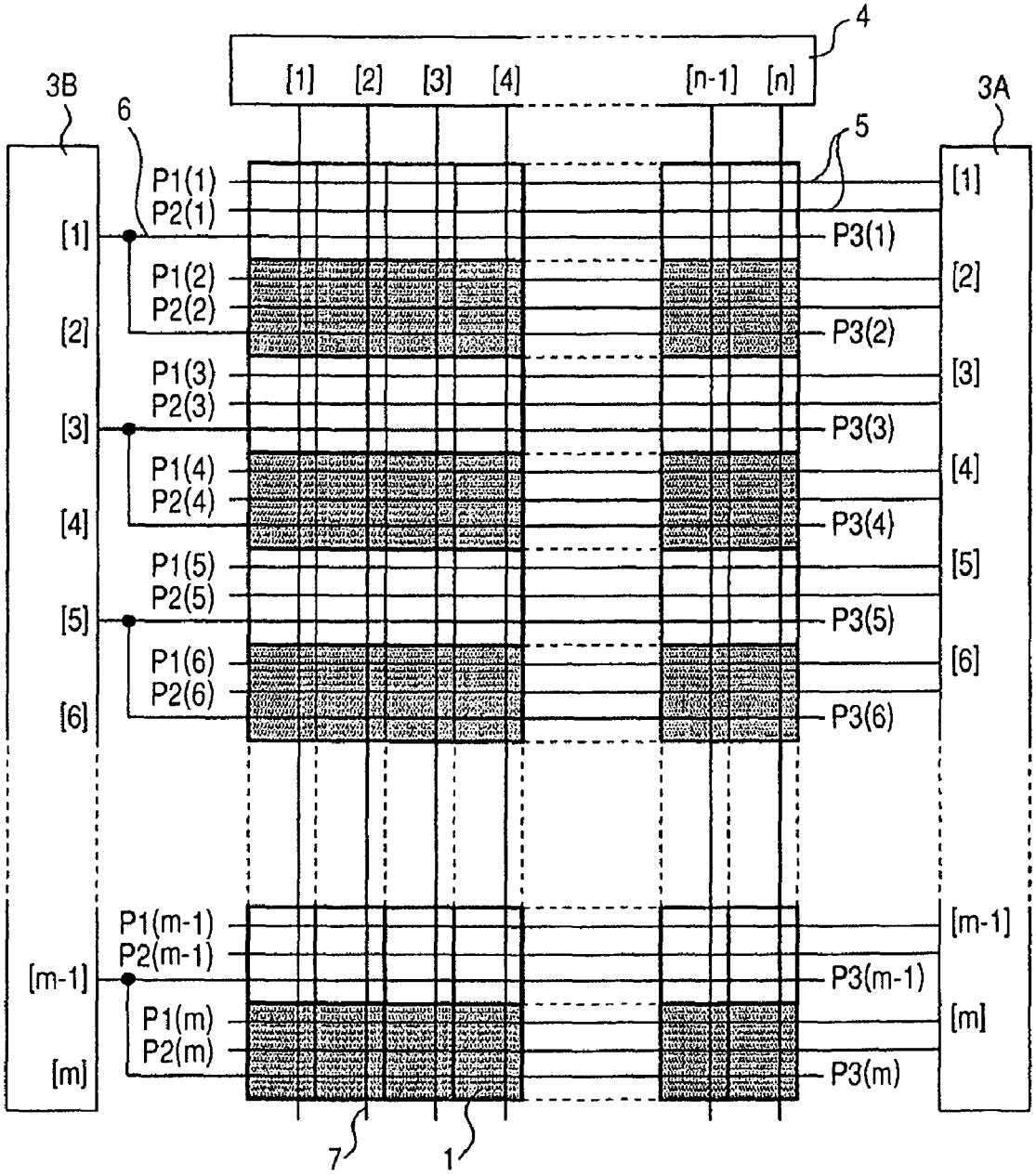
FIG. 10 is another example of the display device according to the present invention.

FIG. 10 shows another overall configuration of the display device according to the present invention.

The display device illustrated in FIG. 10 includes row driving circuits 3A and 3B. The sections a and b in FIG. 8 may be taken to be the row driving circuits 3A and 3B respectively.

In the present embodiment, although the row driving circuit based on the configuration in FIG. 8 is exemplified, aside from the above, any configuration may be used which enables embodying the driving method in FIG. 7.

As described above, according to the present embodiment, a plurality of the light emitting periods is provided in each field while the odd and the even field are alternately subjected to the current programming. For this reason, the current programming is performed at 30 Hz (or, once per frame in each row) for cases where the driving frequency of one field is taken to be 60 Hz, but light can be emitted at 120 Hz (when light is emitted twice per field in each row) or at higher frequencies if the number of times are further increased. Thus, the driving frequency of light emission/non-light emission can be increased, enabling the generation of flicker to be suppressed.

Third Embodiment

Figure 11:
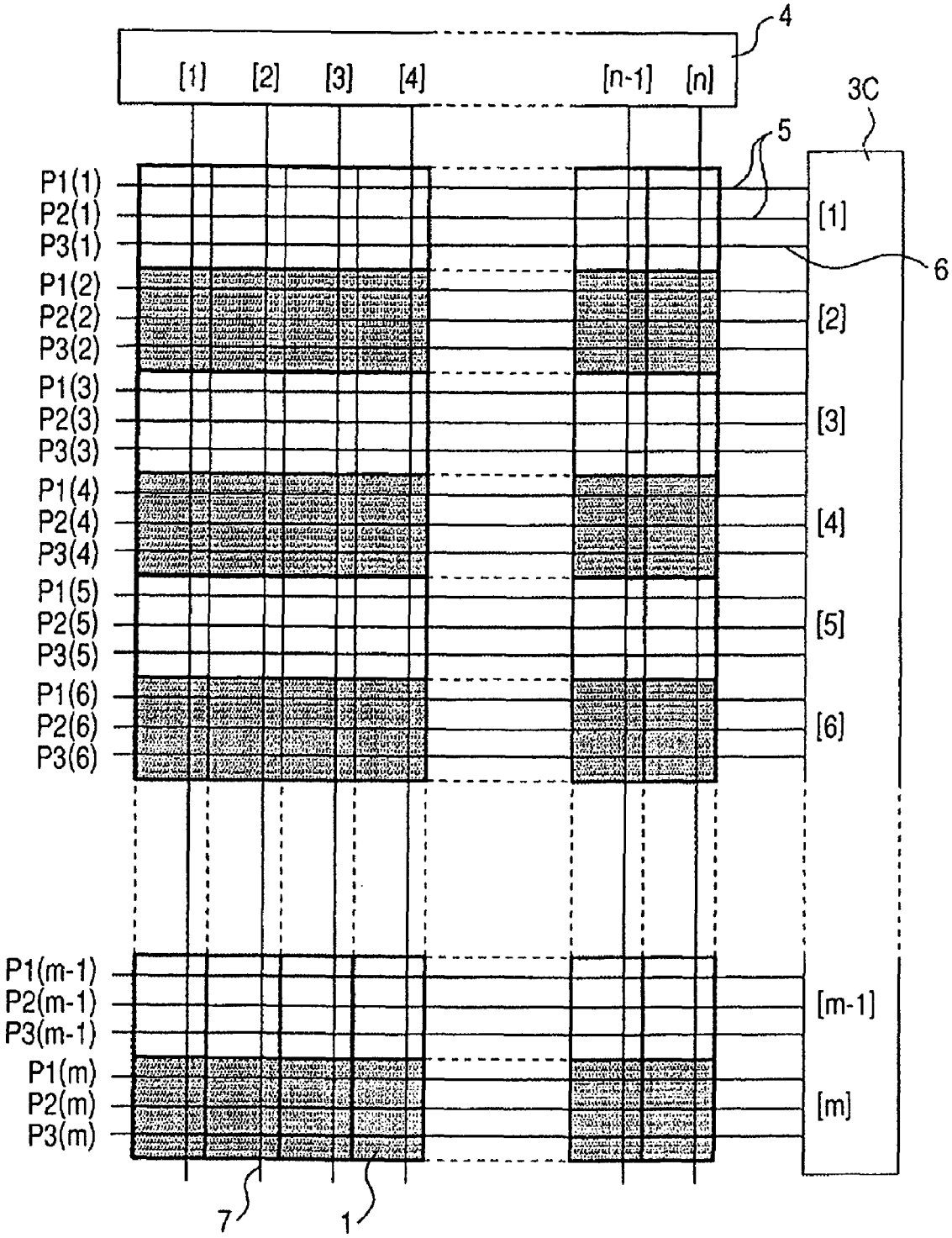
FIG. 11 is another example of the display device according to the present invention.

FIG. 11 shows the overall configuration of the display device according to the present invention.

In FIG. 11, an image display unit includes a pixel 1 formed of an EL element with RGB three primary colors and a pixel circuit 2 composed of TFTs for controlling a current input into the EL element. The pixels are arranged in a matrix of m rows and n columns in the image display unit. Reference characters m and n denote an even number and a natural number respectively. A row driving circuit 3 and a column 4 are provided at the periphery of a display area. The output terminals of the row driving circuit 3C output scanning signals P1(1) to P1(*m*) and P2(1) to P2(*m*) and light emitting period controlling signals P3(1) to P3(*m*). The scanning signals are input into pixel circuits 2 in each row via the first scanning lines 5. The light emitting period controlling signals are input into pixel circuits 2 in each row via the second scanning lines 6. Unlike FIG. 1, the second scanning lines 6 are separately connected to the pixel circuits 2 in all the rows. A video signal is input into the column driving circuit 4. The output terminals thereof output the current data Idata. The current data Idata is input into the pixel circuits in each column through data lines 7.

The pixel circuit 2 and the method of driving the circuit in the present embodiment are the same as those in FIGS. 2 and 3, so that description and figures thereof are omitted.

Figure 12:
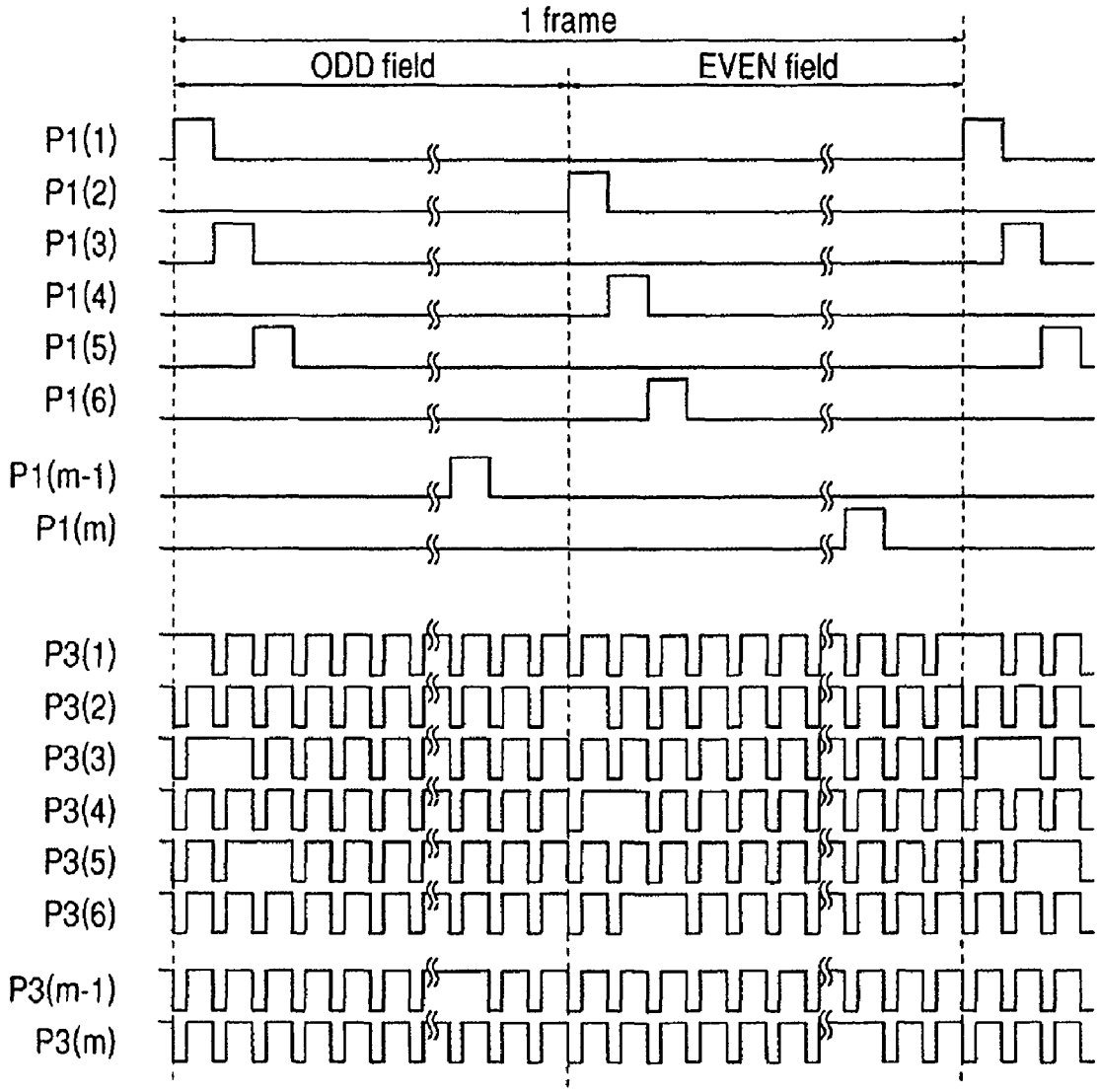
FIG. 12 is a timing chart describing the operation of the display device illustrated in FIG. 11.

FIG. 12 is a timing chart describing the method of driving the display device in the present invention. In FIG. 12, reference characters P1(1) to P1(*m*) express scanning signals P1 corresponding to the first to the m-th row. Reference characters P3(1) to P3(*m*) signify brightness control signals P3 corresponding to the first to the m-th row. The scanning signals P2 are output in the same manner as described in FIG. 3, although the scanning signals P2 are not illustrated for the sake of simplicity.

The output waveforms of the light emitting period control signal P3 are different from those in the driving method described in the timing chart in FIGS. 4 and 7.

The light emitting period control signal P3 in the present embodiment is a continuous signal repeating the High level/the Low level with one period taken to be one scanning period in all the rows. However, in the period during which the scanning signal P1 is in the High level signal period (the current programming period), the light emitting period control signal P3 in that row shall be in the High level signal period (non-light emitting period).

As is the case with the first and the second embodiments, the light emitting period is provided both for the fields subjected to and not subjected to the current programming. In the light emitting period in the fields not subjected to the current programming, light is emitted by current programmed in the previous field. As is the case with the second embodiment, the EL element can repeat light emission/non-light emission plural times for one current programming.

Figure 13:
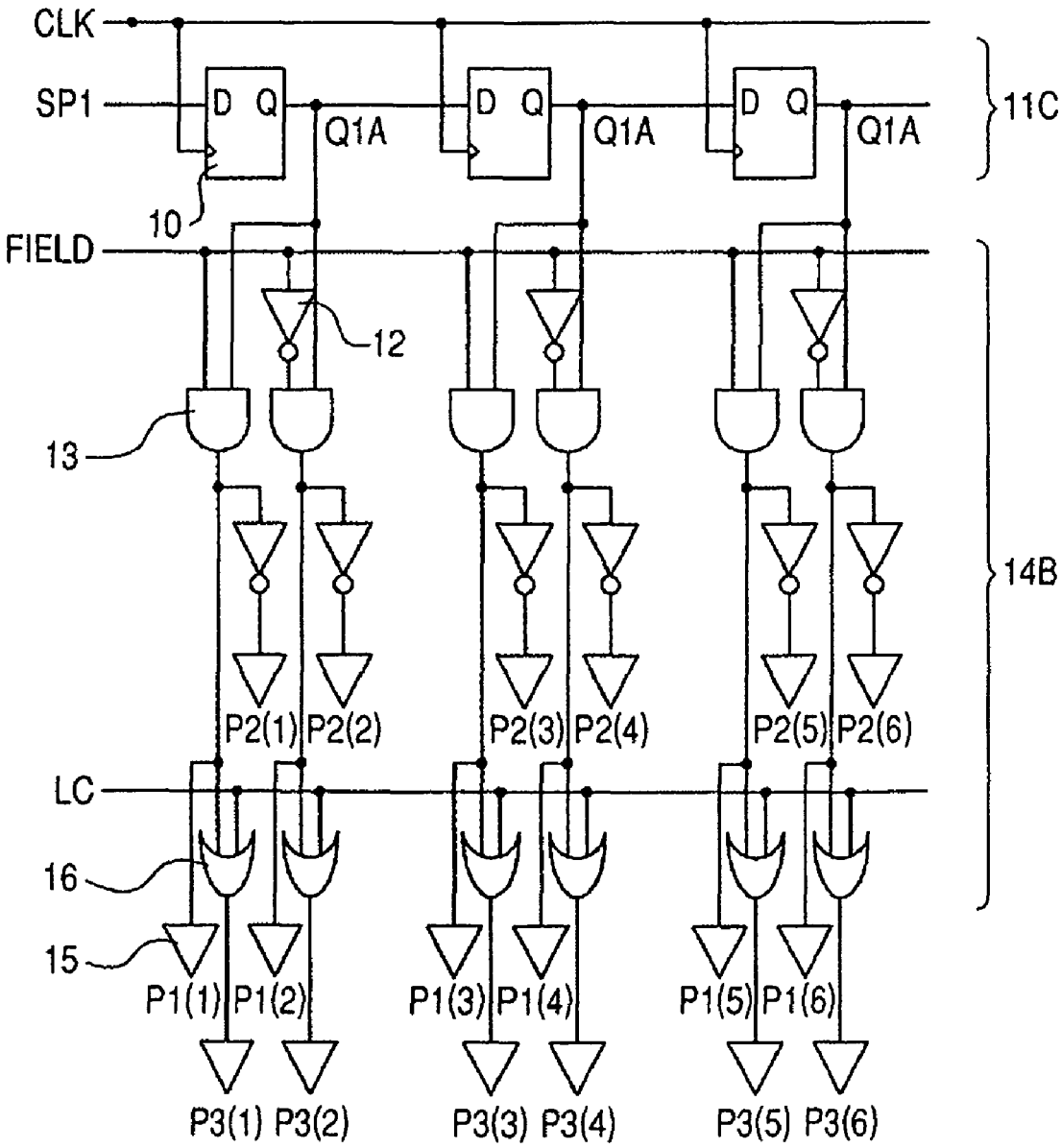
FIG. 13 is one example of a row driving circuit operating of the display device illustrated in FIG. 11.

FIG. 13 shows one example of a row driving circuit 3C operating the display device illustrated in FIG. 11. In FIG. 13, the row driving circuit 3C includes shift register 11C consisting of flip flops 10. The outputs of the shift register 11C are input into a logic circuit 14B consisting of NOT gates 12, AND gates 13 and OR gates 16 to output the scanning signals P1 and P2 and the light emitting period control signal P3 through buffers 15. For the sake of simplicity, outputs only in the first to the sixth rows are illustrated in the figure.

Figure 14:
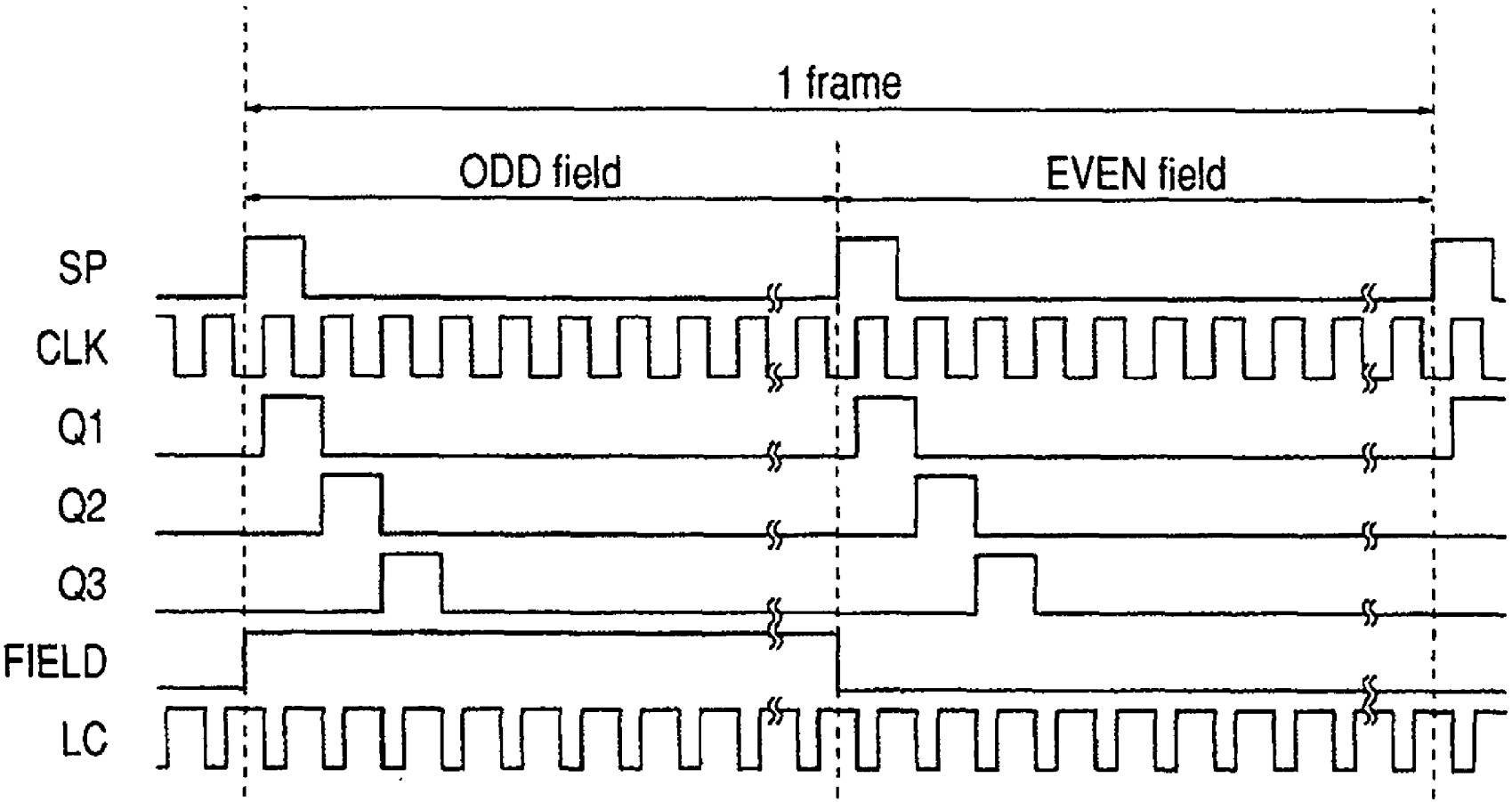
FIG. 14 is a timing chart describing the operation of the row driving circuit illustrated in FIG. 13.

FIG. 14 is a timing chart describing the operation of the row driving circuit illustrated in FIG. 13. Reference character SP denotes a start pulse signal input into the shift register 11C.

The pulse width of the High level signal is taken to be one scanning period. Reference character CLK indicates a clock signal sequentially transferring the start pulse signal SP input into the shift register 11C. One period of the clock signal CLK is taken to be one scanning period. Reference characters Q1 to Q3 represent outputs from the flip flops 10 in the shift register 11C. Reference character FIELD expresses a field signal determining whether a field is odd or even. The pixels in the odd rows are subjected to the current programming while the field signal FIELD is in the High level signal period and the pixels in the even rows are subjected to the current programming while the field signal FIELD is in the Low level signal period.

Reference character LC represents a P3 control signal defining the High level signal period/the Low level signal period of the light emitting period control signal P3 and repeats the High level signal period/the Low level signal period with one period taken to be one scanning period.

While the scanning signal P1 is in the High level signal period (the current programming period), the light emitting period control signal P3 is surely in the High level signal period (non-light emitting period) irrespective of the P3 control signal LC.

The light emitting period can be controlled by varying the duty ratio of the P3 control signal LC to vary the pulse width of the Low level signal of the light emitting period controlling signal P3.

In the present embodiment, although the P3 control signal LC is defined as a continuous signal repeating the High level signal period/the Low level signal period with one period taken to be one scanning period as the best mode, one period does not always need to be taken as one scanning period, but it may be a continuous signal cyclically repeated.

According to the timing chart illustrated in FIG. 3, the light emitting period controlling signal P3 is switched to the Low level signal at the time t2 after a certain time has passed from the time t1 when both the scanning signals P1 and P2 are switched in level. This can be done, as described in the first and the second embodiments, by further reducing the driving capacity of the buffer outputting the light emitting period controlling signal P3 than that of the buffers outputting the scanning signals P1 and P2, or by increasing the buffers outputting the light emitting period controlling signal P3 to a plurality of stages, or by providing a delay circuit by adding a capacitor.

In the present embodiment, although the row driving circuit based on the configuration in FIG. 13 is exemplified, aside from the above, any configuration may be used which enables embodying the driving method in FIG. 12.

As described above, according to the present embodiment, the light emitting period (except in the current programming period) is provided for each scanning period while the odd and the even fields are alternately subjected to the current programming. Thus, the current programming is performed at 30 Hz (or, once per frame in each row) for cases where the driving frequency of one field is taken to be 60 Hz, but light can be emitted at 60 Hz or higher. For example, if one frame period is a 525 scanning period as is the case with the NTSC standard, the number of times in which light is emitted in one frame period is reduced to 524 because one scanning period is deducted in the current programming. Thus, the driving frequency of light emission/non-light emission can be increased to suppress the generation of flicker.

Fourth Embodiment

The present embodiment relates to an example of electronic appliances into which the above embodiments are applied.

Figure 15:
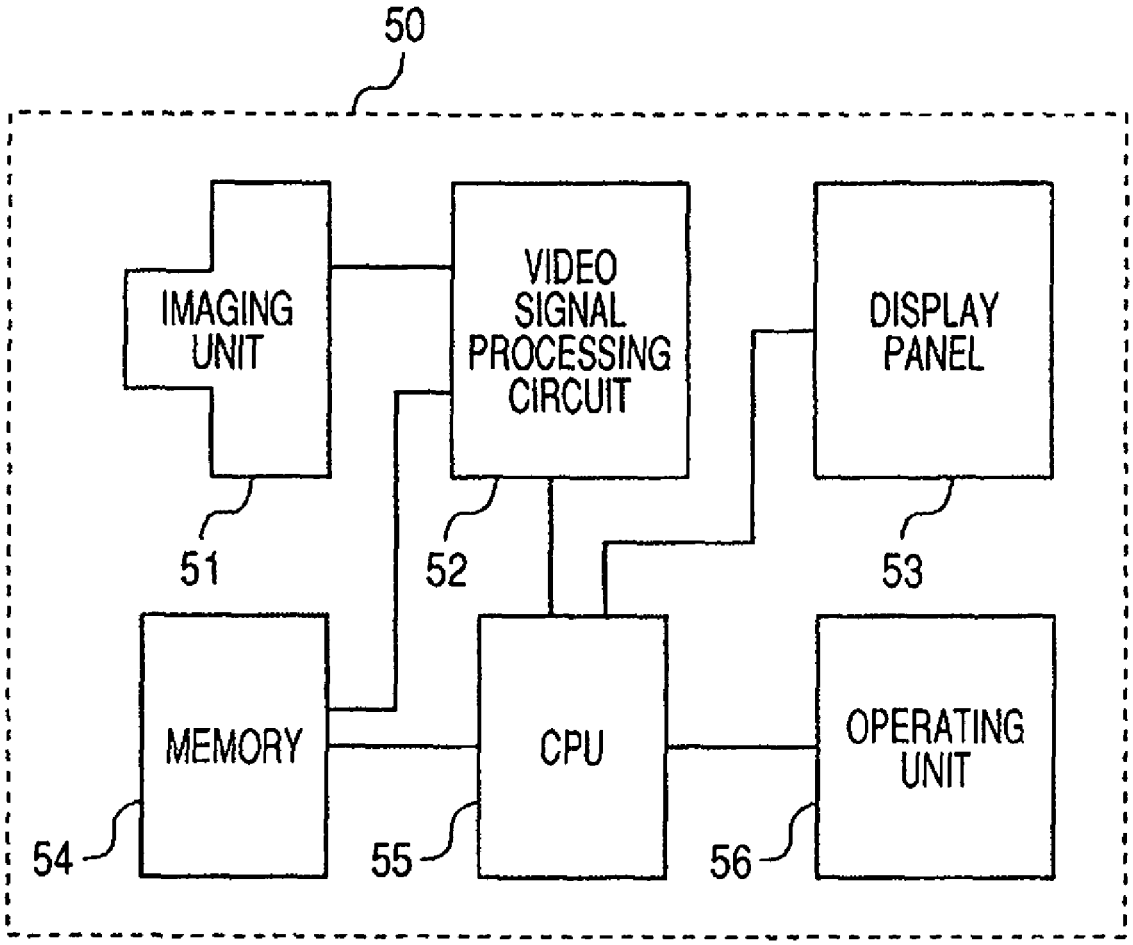
FIG. 15 is a block diagram illustrating the overall configuration of a digital still camera system using the display device according to the present invention.
Figure 16:
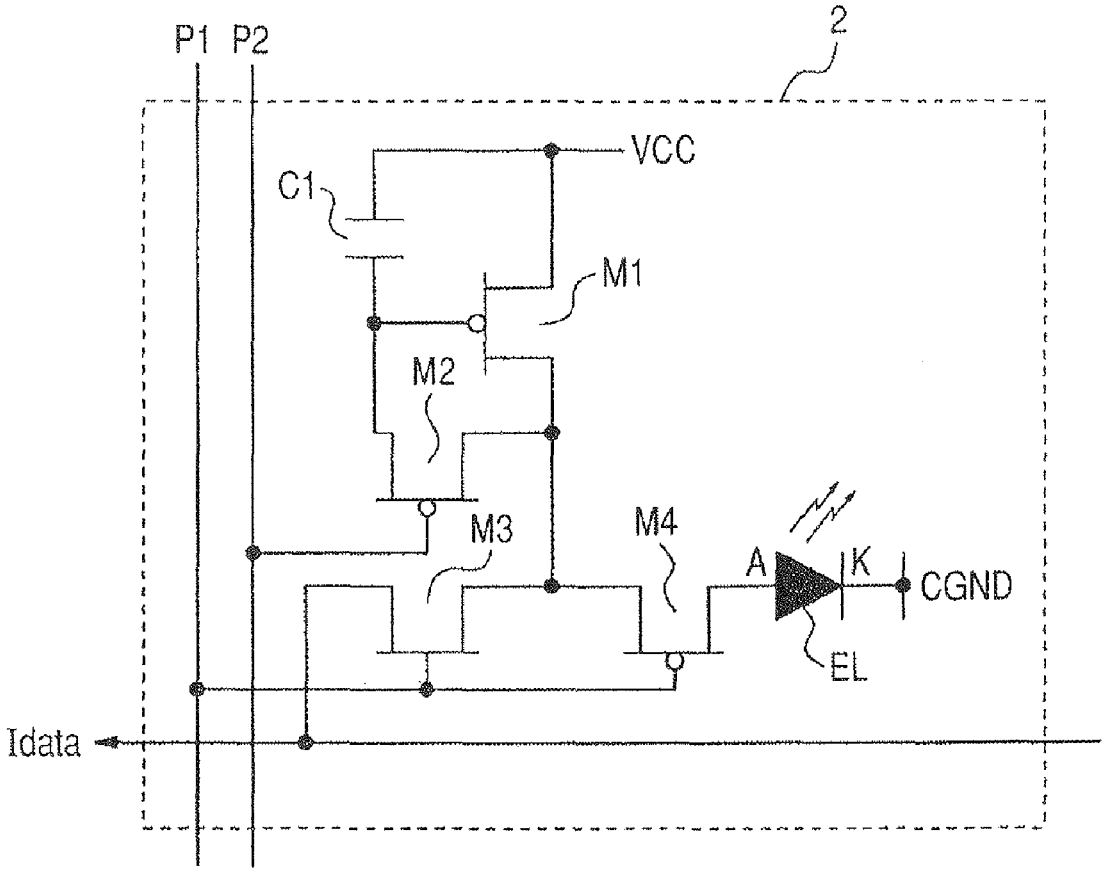
FIG. 16 (PRIOR ART)
FIG. 16 is one example of a pixel circuit in a conventional display device.
Figure 17:
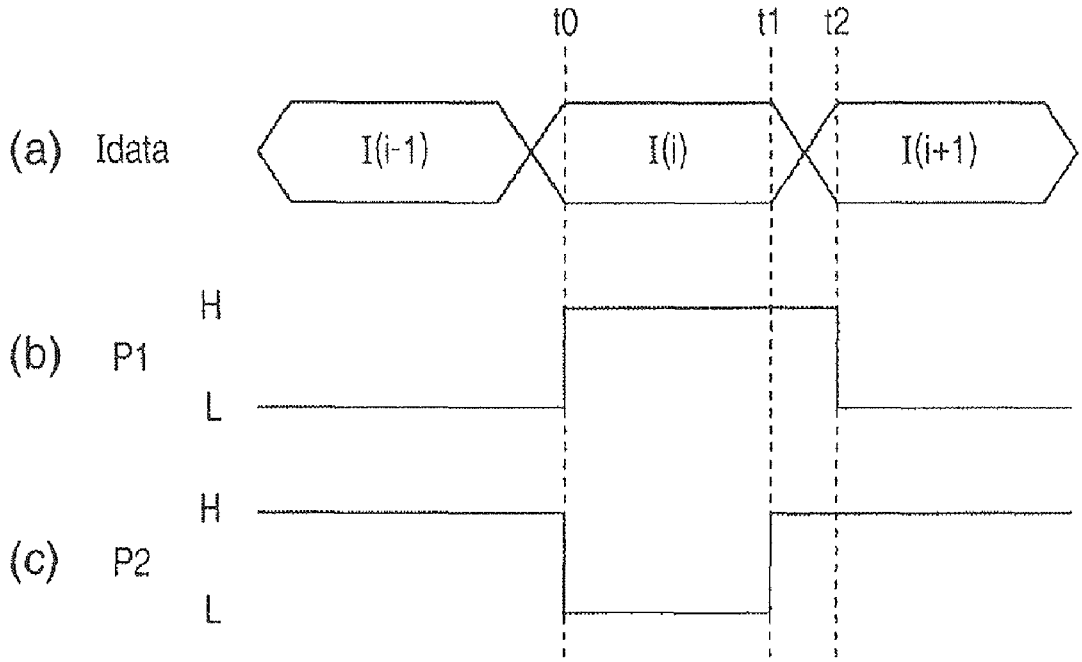
FIG. 17 (PRIOR ART)
FIG. 17 is a timing chart describing the operation of the pixel circuit illustrated in FIG. 16.
Figure 18:
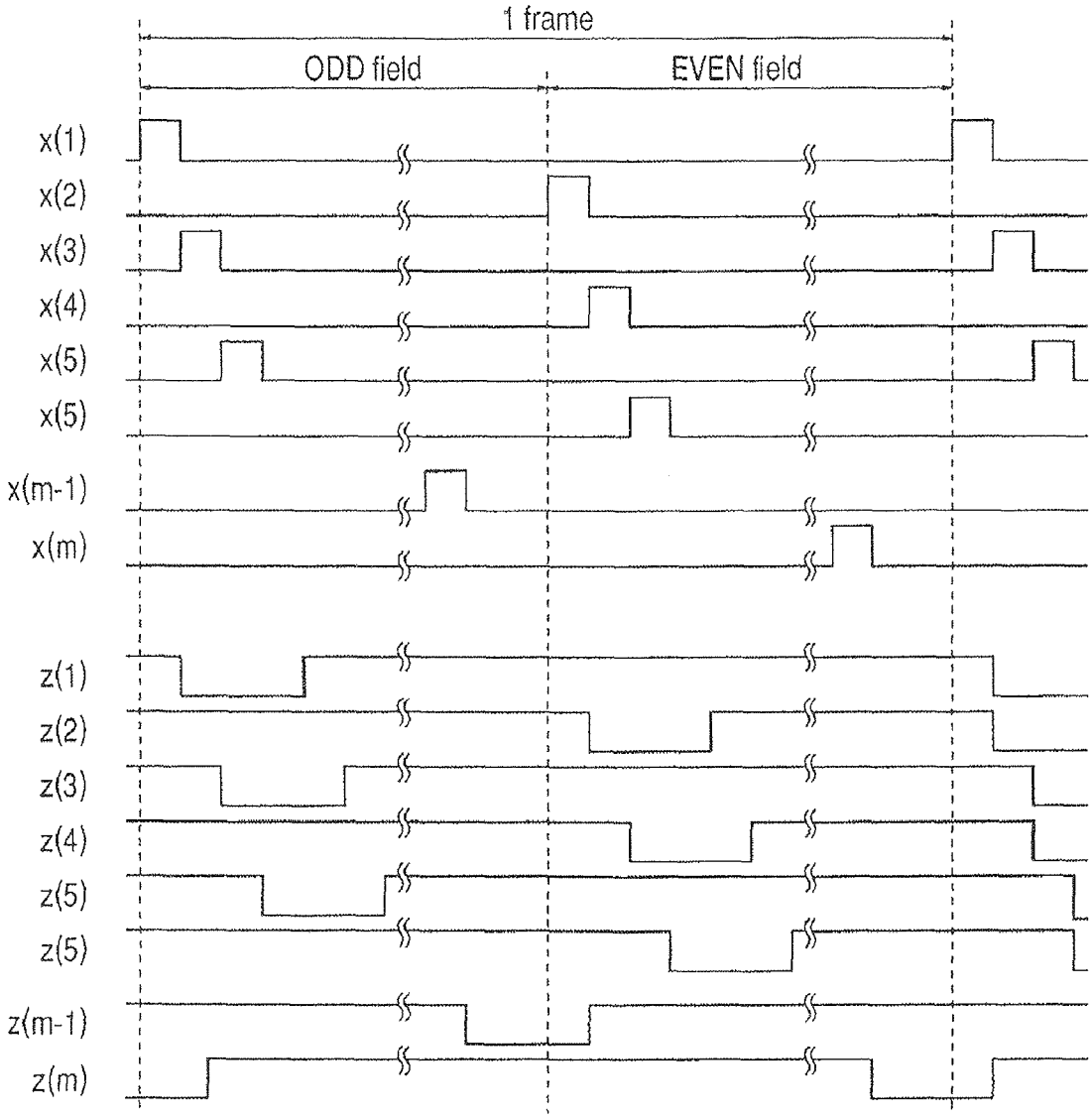
FIG. 18 (PRIOR ART)
FIG. 18 is a timing chart describing the operation of a conventional display device.

FIG. 15 is a block diagram illustrating one example of a digital still camera system according to the present embodiment. In the figure, reference numeral 50 denotes a digital still camera system; 51, an image pickup unit; 52, a video signal processing circuit; 53, a display panel; 54, a memory; 55, a CPU; and 56, an operating unit.

In FIG. 15, videos picked up by the image pickup unit 51 or recorded in the memory 54 are processed by the video signal processing circuit 52 and can be viewed by the display panel 53. The CPU controls the image pickup unit 51, the memory 54 and the video signal processing circuit 52 according to the input from the operating unit 56 to pick up, record, reproduce and display images suited for situations. The display panel 53 can also be used as a display unit for other various electronic appliances.

The present invention relates to the current programming device, the active matrix display device and the method of supplying current thereto and is applied particularly to the active matrix display device used in the current driving display element. The use of the display device enables forming, for example, an information display device. The information display device is embodied in, for example, a cellular phone, portable computer, still camera, or video camera. The information display device is one realizing plural functions each of which is provided in these units. The information display device is also equipped with an information input unit. An information input unit in the cellular phone, for example, includes an antenna. An information input unit in a personal digital assistant (PDA) and a portable PC includes an interface unit for a network. An information input unit in a still camera and movie camera includes a sensor such as CCD or CMOS.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-098011, filed Mar. 31, 2006, which is hereby incorporated by reference herein in its entirety.

The invention claimed is:

1. A display device comprising:

an image display unit comprising a plurality of sets of a display element and a pixel circuit arranged in a matrix in rows and columns, a brightness of the display element being controlled by a current flowing through the display element, and the pixel circuit holding a brightness signal and generating a current according to the brightness signal to supply to the display element;

a first and a second scanning line provided in each row of the image display unit;

a row driving circuit which outputs a first scanning signal to the first scanning lines to define a period for setting the brightness signal to the pixel circuit and a second scanning signal to the second scanning lines to define a period during which the pixel circuit supplies the current to the display element;

a data line provided in each column of the image display unit; and a column driving circuit which outputs the brightness signal to the data lines; wherein the following two operations are alternately repeated:

a first operation in which the row driving circuit outputs the first scanning signals to the first scanning lines in odd rows, and the column driving circuit outputs the brightness signal to the data lines to set the brightness signal to the pixel circuit in the odd rows of the image display unit; and a second operation in which the row driving circuit outputs the first scanning signals to the first scanning lines in even rows, and the column driving circuit outputs the brightness signal to the data lines to set the brightness signal to the pixel circuit in the even rows of the image display unit, and the second scanning signals are applied two or more times to each of the second scanning lines in a period of the first and second operation, wherein in the first operation, the odd rows are subjected to current programming, and immediately thereafter, the EL elements in the odd rows emit light, and the EL elements in the even rows store data at the time of the previous programming, and the EL elements in the even rows emit light with the same brightness as in the previous second operation, and in the second operation, the even rows are subjected to current programming, and immediately thereafter, the EL elements in the even rows emit light, and the EL elements in the odd rows emit light according to the current programming to which the previous first operation is subjected.

2. The display device according to claim 1, wherein the second scanning signals are applied simultaneously to a pair of the second scanning lines in adjacent odd and even rows.

3. The display device according to claim 2, wherein the pair of second scanning lines in the two adjacent odd and even rows are connected.

4. The display device according to claim 1, wherein a period of application of the second scanning signal to one of the second scanning lines does not overlap a period of application of the first scanning signal to one of the first scanning lines.

5. The display device according to claim 1, wherein the row driving circuit includes a shift register and outputs the second scanning signal having a period equal to the period during which an input signal to the shift register continues.

6. The display device according to claim 1, wherein the period of the second scanning signal is controlled by an external signal.

7. The display device according to claim 6, wherein the external signal is a continuous signal whose one period is taken to be one scanning period.

8. The display device according to claim 1, wherein the display element is an electroluminescent element.

* * * * *